US008576125B2

(12) United States Patent
Ridgeway

(10) Patent No.: US 8,576,125 B2
(45) Date of Patent: Nov. 5, 2013

(54) PLANAR WIDEBAND ANTENNA

(75) Inventor: Robert Wayne Ridgeway, Saratoga Springs, UT (US)

(73) Assignee: Digi International Inc., Minnetonka, MN (US)

( * ) Notice: Subject to any disclaimer, the term of this patent is extended or adjusted under 35 U.S.C. 154(b) by 476 days.

(21) Appl. No.: 12/915,763

(22) Filed: Oct. 29, 2010

(65) Prior Publication Data

US 2011/0156981 A1 Jun. 30, 2011

Related U.S. Application Data

(60) Provisional application No. 61/256,767, filed on Oct. 30, 2009.

(51) Int. Cl.
*H01Q 1/38* (2006.01)
*H01Q 1/50* (2006.01)

(52) U.S. Cl.
USPC ..... 343/700 MS; 343/862

(58) Field of Classification Search
USPC ..... 343/700 MS, 850, 860, 862
See application file for complete search history.

(56) References Cited

U.S. PATENT DOCUMENTS

| | | | | |
|---|---|---|---|---|
| 6,590,541 | B1 | 7/2003 | Schultze | |
| 6,759,984 | B2 | 7/2004 | Wielsma | |
| 6,768,461 | B2 * | 7/2004 | Huebner et al. | 343/700 MS |
| 7,034,750 | B2 | 4/2006 | Asakura et al. | |
| 7,256,750 | B1 | 8/2007 | Honda | |
| 7,307,588 | B2 * | 12/2007 | Tseng | 343/700 MS |
| 7,358,918 | B2 * | 4/2008 | Itsuji | 343/772 |
| 2002/0175877 | A1 | 11/2002 | Schantz | |
| 2006/0139225 | A1 | 6/2006 | Taguchi et al. | |
| 2007/0120741 | A1 * | 5/2007 | Tseng | 343/700 MS |
| 2007/0194990 | A1 * | 8/2007 | Ling et al. | 343/700 MS |
| 2011/0156981 | A1 | 6/2011 | Ridgeway | |

FOREIGN PATENT DOCUMENTS

| | | |
|---|---|---|
| EP | 1986270 | 10/2008 |
| WO | WO-2006002090 A1 | 1/2006 |

OTHER PUBLICATIONS

"International Application No. PCT/US2010/054718, International Search Report and Written Opinion mailed Feb. 25, 2011", 10 pgs.
Yanagi, Masahiro, et al., "A Planar UWB Monopole Antenna Formed on a Printed Circuit Board", 1 pg.
Yang, H.Y. David, "Printed Straight F Antennas for WLAN and Bluetooth", Dept. of Electrical and Computer Engineering, Univ. of Illinois at Chicago, 4 pgs.

* cited by examiner

*Primary Examiner* — Hoang V Nguyen
(74) *Attorney, Agent, or Firm* — Fogg & Powers LLC

(57) ABSTRACT

An approximately planar wideband antenna can include a first conductive portion coupled to a dielectric portion and mechanically supported by the dielectric portion, the first conductive portion including at least one edge corresponding to a planar conic section, such as including one or more of an elliptic, a parabolic, or a hyperbolic shape. Such an antenna can be electrically coupled to a matching circuit, the matching circuit configured provide a specified input impedance corresponding to a specified range of frequencies. Such a range of frequencies can span at least an octave, or more.

19 Claims, 9 Drawing Sheets

PLANAR WIDEBAND ANTENNA

CLAIM OF PRIORITY

This patent application claims the benefit of priority, under 35 U.S.C. Section 119(e), to Ridgway, U.S. Provisional Patent Application Ser. No. 61/256,767, entitled "WIDEBAND ANTENNA," filed on Oct. 30, 2009, which is hereby incorporated by reference herein in its entirety.

TECHNICAL FIELD

This document pertains generally, but not by way of limitation, to antennas, and more particularly to wideband antennas for use in wireless communications.

BACKGROUND

Information can be wirelessly transferred using electromagnetic waves. Generally, such electromagnetic waves are either transmitted or received using a specified range of frequencies, such as established by a spectrum allocation authority for a location where a particular wireless device or assembly will be used or manufactured. Such wireless devices or assemblies generally include one or more antennas, and each antenna can be configured for transfer of information at a particular range of frequencies. Such ranges of frequencies can include frequencies used by wireless digital data networking technologies (e.g., including one or more of the IEEE 802.11 family of "Wi-Fi" standards, one or more of the IEEE 802.16 family of "WiMax" standards, or including other protocols or standards), cellular telephone or data services, fixed or mobile terrestrial radio, satellite communications, or other applications. For example, in the United States, various ranges of frequencies are allocated for low-power industrial, scientific, or medical use (e.g., an "ISM" band.), such as including a first ISM band in the range of 902 MHz. to 928 MHz., or including a second ISM band in the range of 2400 MHz. to 2500 MHz., among other ranges of frequencies.

OVERVIEW

A wireless device or assembly can include circuitry, such as to wirelessly transfer information electromagnetically using an antenna included as a portion of the wireless assembly. The present inventors have recognized, among other things, that a wireless device or assembly can be simpler or manufactured for lower cost if a single antenna is used, as compared to multiple antennas, even when the device or assembly is otherwise configured for operation using multiple ranges of frequencies. Such a single "wideband" antenna can be configured for operation in multiple widely-spaced frequency ranges (e.g., separated by an octave or more, or even a decade), such as providing a specified return loss or radiation efficiency. Generally, a wideband antenna can provide a specified return loss or input impedance throughout a desired range of frequencies. Such a range of frequencies can span an octave, or more, unlike an antenna tuned for operation at a single, relatively narrow range of frequencies (e.g., much less than an octave), or even antennas tuned for operation in multiple narrow ranges of frequencies.

The present inventors have also recognized that generally, an approximately planar antenna, such as fabricated using a clad printed circuit laminate or one or more other materials, can be lower in cost or simpler to fabricate than other antenna configurations. Moreover, the present inventors have also recognized that such a planar wideband antenna can be included as a portion of a wireless device or assembly, such as to provide support for wireless information transfer in a variety of different locations worldwide in compliance with local spectrum allocation requirements, without requiring multiple or different antenna configurations for each location.

In an example, an approximately planar wideband antenna can include a first conductive portion coupled to a dielectric portion and mechanically supported by the dielectric portion, the first conductive portion including at least one edge corresponding to a planar conic section, such as including one or more of an elliptic, a parabolic, or a hyperbolic shape. Such an antenna can be electrically coupled to a matching circuit, the matching circuit configured provide a specified input impedance corresponding to a specified range of frequencies. Such a range of frequencies can span at least an octave, or more.

Example 1 includes subject matter (such as an apparatus) comprising an approximately planar wideband antenna including a first conductive portion coupled to a dielectric portion and mechanically supported by the dielectric portion, the first conductive portion including at least one edge corresponding to a planar conic section, a matching circuit electrically coupled to the first conductive portion and configured to provide a specified input impedance corresponding to a specified range of frequencies, the specified range of frequencies including a range of frequencies spanning at least an octave, and the planar conic section including one or more of an elliptic, a parabolic, or a hyperbolic shape.

In Example 2, the subject matter of Example 1 can optionally include a matching circuit conductively coupled to the first conductive portion.

In Example 3, the subject matter of one or any combination of Examples 1-2 can optionally include a matching circuit reactively coupled to the first conductive portion.

In Example 4, the subject matter of one or any combination of Examples 1-3 can optionally include a matching circuit comprising a distributed matching structure coupled to the first conductive portion of the planar wideband antenna and configured to provide, at least in part, the specified input impedance at least in part using a distributed inductance or capacitance of the distributed matching structure.

In Example 5, the subject matter of one or any combination of Examples 1-4 can optionally include a distributed matching structure comprising a coplanar waveguide.

In Example 6, the subject matter of one or any combination of Examples 1-5 can optionally include a matching circuit comprising a discrete component, the combination of the discrete component and the distributed matching structure configured to provide the specified input impedance.

In Example 7, the subject matter of one or any combination of Examples 1-6 can optionally include a printed circuit board assembly including a conductive layer comprising the first conductive portion and a dielectric layer comprising the dielectric portion.

In Example 8, the subject matter of one or any combination of Examples 1-7 can optionally include a dielectric portion comprising a glass-epoxy laminate, and the first conductive portion includes copper.

In Example 9, the subject matter of one or any combination of Examples 1-8 can optionally include a printed circuit board comprising a return plane, the return plane located near a conductive housing and electrically coupled to the conductive housing.

In Example 10, the subject matter of one or any combination of Examples 1-9 can optionally include a conductive housing at least partially containing a transmitter or a receiver circuit configured to use the planar wideband antenna to wirelessly transfer information electromagnetically using at least a portion of the specified range of frequencies.

In Example 11, the subject matter of one or any combination of Examples 1-10 can optionally include a second conductive portion including at least one edge corresponding to a planar conic section.

In Example 12, the subject matter of one or any combination of Examples 1-11 can optionally include one or more of the first conductive portion or the matching circuit electrically coupled to the second conductive portion reactively.

In Example 13, the subject matter of one or any combination of Examples 1-12 can optionally include a first conductive portion located on a first conductive layer of a printed circuit board assembly, and a second conductive portion located on a second conductive layer of the printed circuit board assembly.

In Example 14, the subject matter of one or any combination of Examples 1-13 can optionally include a specified range of frequencies comprising a range from about 700 MHz. to about 2500 MHz.

Example 15 can include, or can optionally be combined with the subject matter of one or any combination of Examples 1-14 to include, subject matter (such as a method, a means for performing acts, or a machine-readable medium including instructions that, when performed by the machine, cause the machine to perform acts) to form an approximately planar wideband antenna including a first conductive portion coupled to a dielectric portion and mechanically supported by the dielectric portion, the first conductive portion including at least one edge corresponding to a planar conic section, electrically couple a matching circuit to the first conductive portion, the matching circuit providing a specified input impedance for the planar wideband antenna, the specified input impedance corresponding to a specified range of frequencies, the specified range of frequencies including a range of frequencies spanning at least an octave, and the planar conic section including one or more of an elliptic, a parabolic, or a hyperbolic shape.

In Example 16, the subject matter of Example 15 can optionally include providing a second conductive portion including at least one edge corresponding to a planar conic section.

In Example 17, the subject matter of one or any combination of Examples 15-16 can optionally include forming the first conductive portion on a first conductive layer, forming the second conductive portion on a second conductive layer, and separating the first and second conductive layers using the dielectric portion.

In Example 18, the subject matter of one or any combination of Examples 15-17 can optionally include patterning a first conductive portion onto a first conductive layer included as a portion of a printed circuit board assembly, the first conductive layer mechanically coupled to a dielectric portion of the printed circuit board assembly, and the first conductive portion including at least one edge corresponding to a planar conic section, patterning at least a portion of a matching circuit onto the first conductive layer included as a portion of the printed circuit board assembly, the matching circuit electrically coupled to the first conductive portion and configured to provide a specified input impedance for the planar wideband antenna, the specified input impedance corresponding to a specified range of frequencies, the specified range of frequencies includes a range of frequencies spanning at least an octave, and the planar conic section including one or more of an elliptic, a parabolic, or a hyperbolic shape.

In Example 19, the subject matter of Example 18 can optionally include patterning a second conductive portion, the second conductive portion including at least one edge corresponding to a planar conic section.

In Example 20, the subject matter of one or any combination of Examples 18-19 can optionally include patterning a second conductive portion onto a second conductive layer included as a portion of the printed circuit board assembly, the first and second conductive layers are separated by the dielectric portion.

These examples can be combined in any permutation or combination. This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
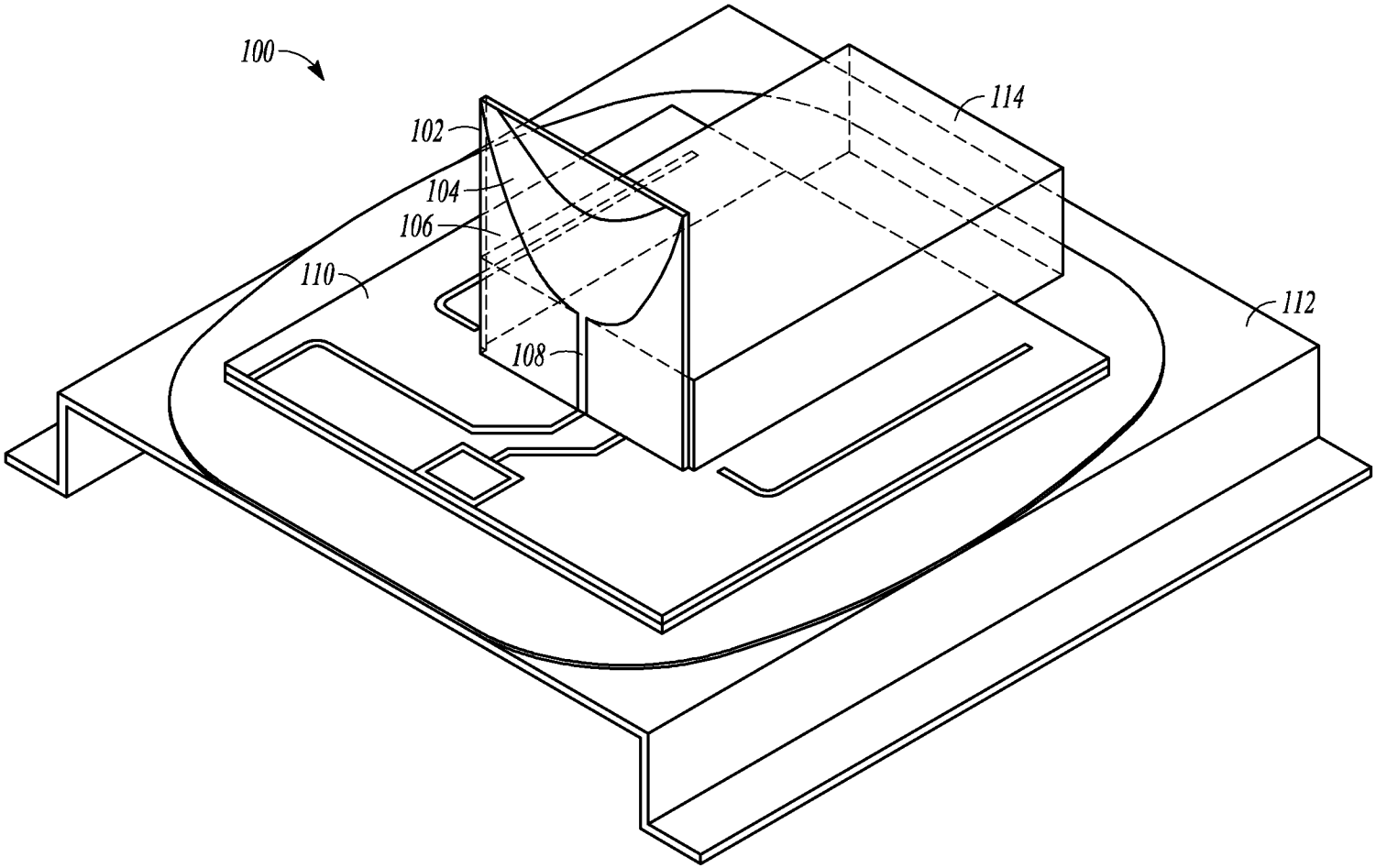
FIG. 1 illustrates generally an example of an apparatus that can include a planar antenna assembly.

FIG. 1 illustrates generally an example of an apparatus 100 that can include an approximately planar antenna assembly 102, such as including a conductive portion 104 and a dielectric portion 106. In the example of FIG. 1, the conductive portion 104 can be electrically fed by a microstrip or printed circuit board trace 108, such as forming part of a coplanar waveguide (CPW) included as a portion of the antenna assembly 102, or using one or more other conductively- or reactively-coupled feed structures (e.g., a coaxial feed, a microstrip feed, a stripline feed, a capacitive feed, or one or more other structures). In an example the CPW can be a "grounded" CPW structure (e.g., where the CPW trace 108 is located above a return plane, separated by the dielectric portion 106), or an "ungrounded" CPW structure.

In the example of FIG. 1, the antenna assembly 102 can be mechanically coupled to a conductive housing 114, such as a shielded enclosure including electronic circuitry, including a transmitter or receiver configured to wirelessly transfer information electromagnetically using the antenna assembly 102. In an example, one or more of the antenna assembly 102 or the conductive housing 114 can be electrically coupled to a printed circuit board 110, such as including a part or portion of a transmitter or receiver, such as mounted on or within a mechanical support 112.

In an example, the conductive portion 104 of the antenna assembly 102 can be similar to a planar projection of a disc-cone (e.g. "discone") antenna. Such a planar or approximately two-dimensional construction can make the antenna assembly 102 desirable for use in a vehicular or an avionics application, such as conforming to or being located within a portion of a vehicle (e.g., a car or truck) or an aircraft. Such a flat or planar construction can both reduce a weight, a volume, or a wind resistance associated with the antenna assembly 102 as compared to using other non-planar antenna configurations.

In the example of FIG. 1, the dielectric portion 106 can include an epoxy, a glass-epoxy laminate, a polyimide material that optionally include a rigid backing material, a polytetrafluoroethylene (PTFE) material, or one or more other materials. In an example, the dielectric portion 106 can include a glass-epoxy laminate such as FR-4, FR-406, or one or more other materials generally used for commodity printed circuit board fabrication (e.g., printed wiring board materials). For example, the dielectric portion 106 can provide both insulation of the conductive portion 104 from the conductive housing 114, or mechanical support for the antenna assembly 102. For example, the dielectric portion 106 can provide rigidity, such as to allow a cantilevered portion of the antenna assembly 102, including the conductive portion 104, to rise above the housing 114, to provide a more omni-directional antenna response around the horizon (e.g., in a horizontal plane roughly perpendicular to a plane defined by the conductive portion 104).

In the examples of FIGS. 1, 2A-B, and 5, a conductive portion 104 can include at least one edge corresponding to a planar conic section, such as defined by a parabolic, an elliptic, or a hyperbolic shape. For example, the conductive portion 104 in FIG. 1 includes two edges, with each edge having a parabolic shape. The area, maximum dimensions, and shape of the conductive portion 104 can be used to adjust the input impedance or radiative modes supported by the antenna assembly 102, such as to provide a desired or specified input impedance within a specified input impedance range, such as throughout a specified or desired range of operating frequencies. In the example of FIG. 1, as shown by the simulation results in FIGS. 3-4, the input impedance of the antenna assembly 102 can be adjusted across a broad range of frequencies to provide an input impedance close to 50 ohms (real), or some other desired impedance, such as using a combination of the CPW trace 108, one or more discrete components, or the antenna conductive portion 104 (or a combination of any of these or other components or structures).

In this manner, the CPW trace 108 or surrounding conductive materials such as the conductive housing 114 can be used to reduce or minimize the antenna assembly's sensitivity to changes in the ground environment surrounding the antenna assembly 102, by providing a specified input impedance under a variety of conditions. For example, in a vehicular or an avionics application, a large surrounding conductor such as a portion of a car body or a skin of an aircraft can alter one or more antenna characteristics, such as "pulling" or otherwise changing one or more resonant frequencies or modes supported by the antenna, or creating an undesired shift in input impedance. Use of the CPW trace 108 concentrates an electromagnetic field in a region between the trace 108 and nearby surrounding conductive structures (e.g., a ground plane included as a portion of the antenna assembly 102, or the conductive housing 114), which can reduce interaction between the feed 108 and further away conductors as compared to using other feed or matching structures. In this manner, the CPW trace 108 can be a portion of a distributed matching structure (e.g., in contrast to using a discrete matching network exclusively). In an example, the CPW trace 108 can terminate into a coaxial connector, such as to provide a port to connect the antenna assembly 102 to circuitry included nearby or within the conductive housing 114.

Figure 2A:
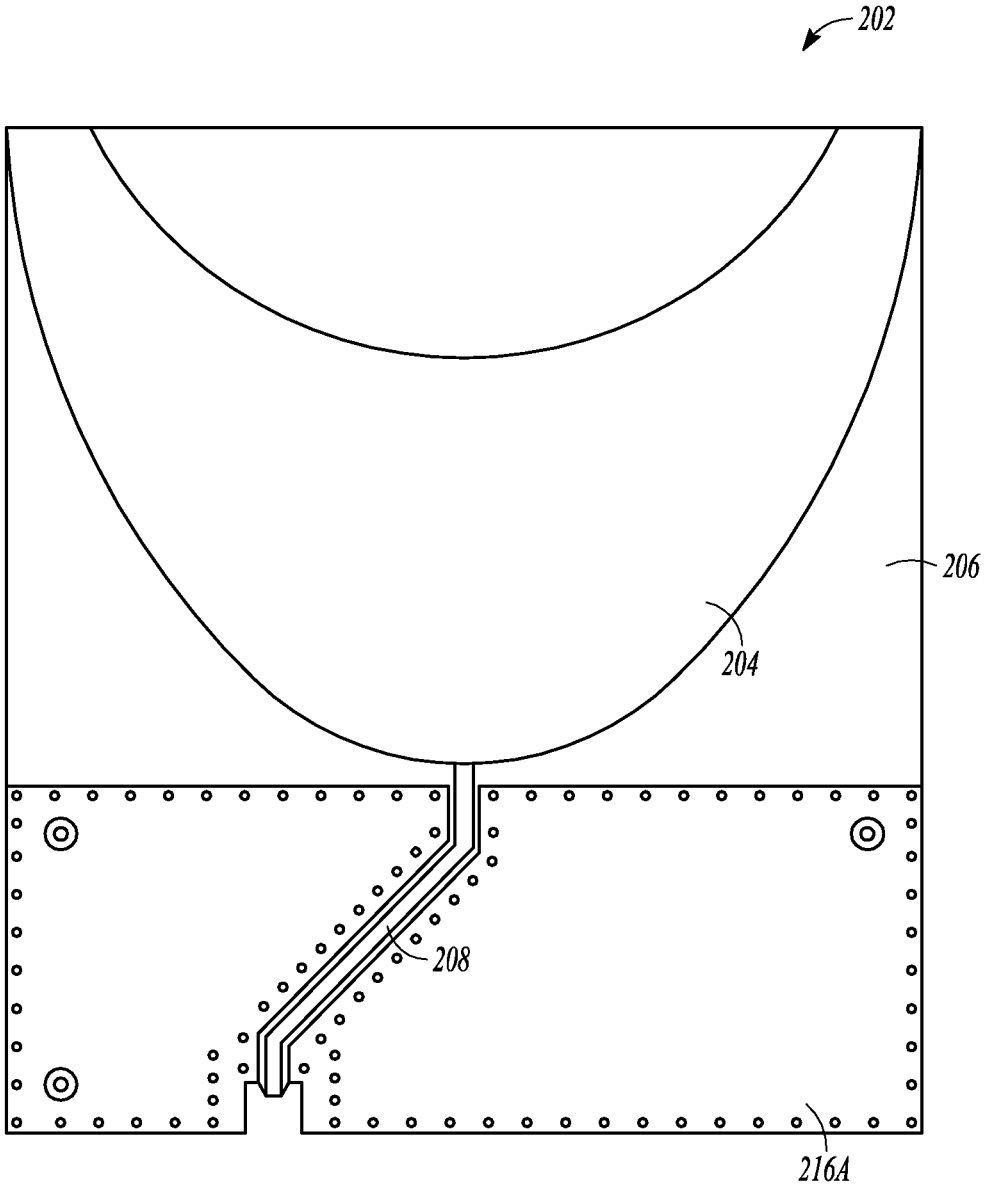
FIGS. 2A-B illustrates generally an example of an apparatus that can include a planar antenna pattern, such as included as a portion of a printed circuit board assembly.
Figure 2B:
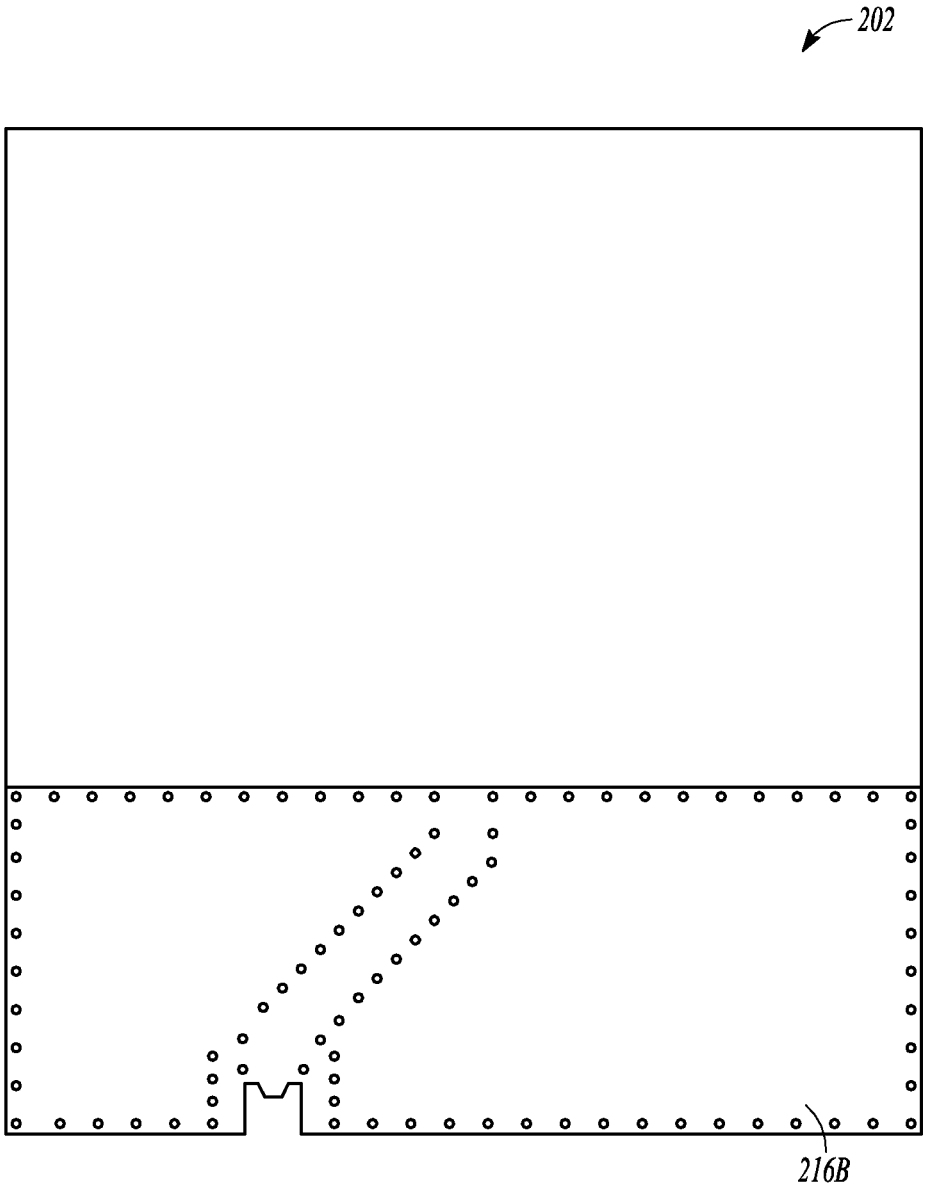

FIGS. 2A-B illustrates generally an example of an apparatus that can include a planar antenna pattern, such as included as a portion of a printed circuit board assembly 202. In FIG. 2A, a first conductive layer can include a first conductive portion 204, such as including one or more edges defined by a planar conic section as shown and discussed in the example of FIG. 1. The first conductive portion 204 can be fed by or otherwise electrically coupled to a conductive trace 208, such as adjacent to a conductive ground or return plane 216A.

In the example of FIG. 2A, a dielectric portion (e.g., a printed circuit board laminate layer including a dielectric material) can separate the first conductive portion 204, and trace 208 from the conductive plane 216A. In FIG. 2B, a second conductive layer (shown as though the viewer is looking through the assembly 202) can include a second conductive ground or return plane 216B. In an example, the first and second planes 216A-B can be electrically coupled via an array of "stitching vias," such as plated through-holes, penetrating through the dielectric portion 204. The vias can be spaced so that high-frequency currents induced in either layer can be efficiently coupled between layers, such as to provide a ground coplanar waveguide configuration for the feed trace 208.

Figure 5:
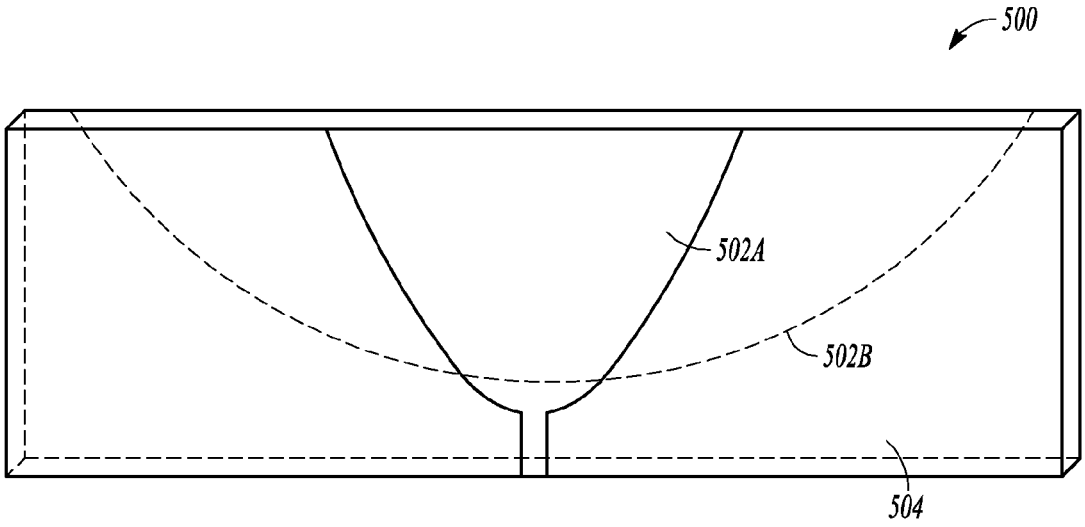
FIG. 5 illustrates generally an example of an apparatus that can include a planar antenna assembly, such as including a passively-driven element.

In an example, the antenna assembly shown in the examples of FIGS. 1 and 2A-B can include a second conductive portion, such as included as a portion of the conductive layer shown in FIG. 2B, such as to provide the antenna configuration shown in the example of FIG. 5.

In an example, one or more of the first conductive portion 204, or the planes 216A-B can be patterned lithographically or otherwise formed in a sheet of conductive material (e.g., a copper foil included rolled-annealed copper, or electrodeposited copper, or one or more other metals or alloys such as silver, tungsten, or aluminum). Such lithographic techniques can include one or more processes generally used for commodity printed circuit board fabrication, such as similarly used for fabrication of consumer-grade electronic devices or assemblies.

In an illustrative example, the overall dimensions of the printed circuit board assembly shown in FIGS. 2A-B (and similar to the example of FIG. 1) can be about 3.5 inches in width (e.g., about 8.89 centimeters in width), and about 3.8 inches in height (e.g., about 9.652 centimeters in height). Such dimensions can be adjusted or scaled, depending on the minimum desired usable frequency for the antenna assembly.

Figure 3:
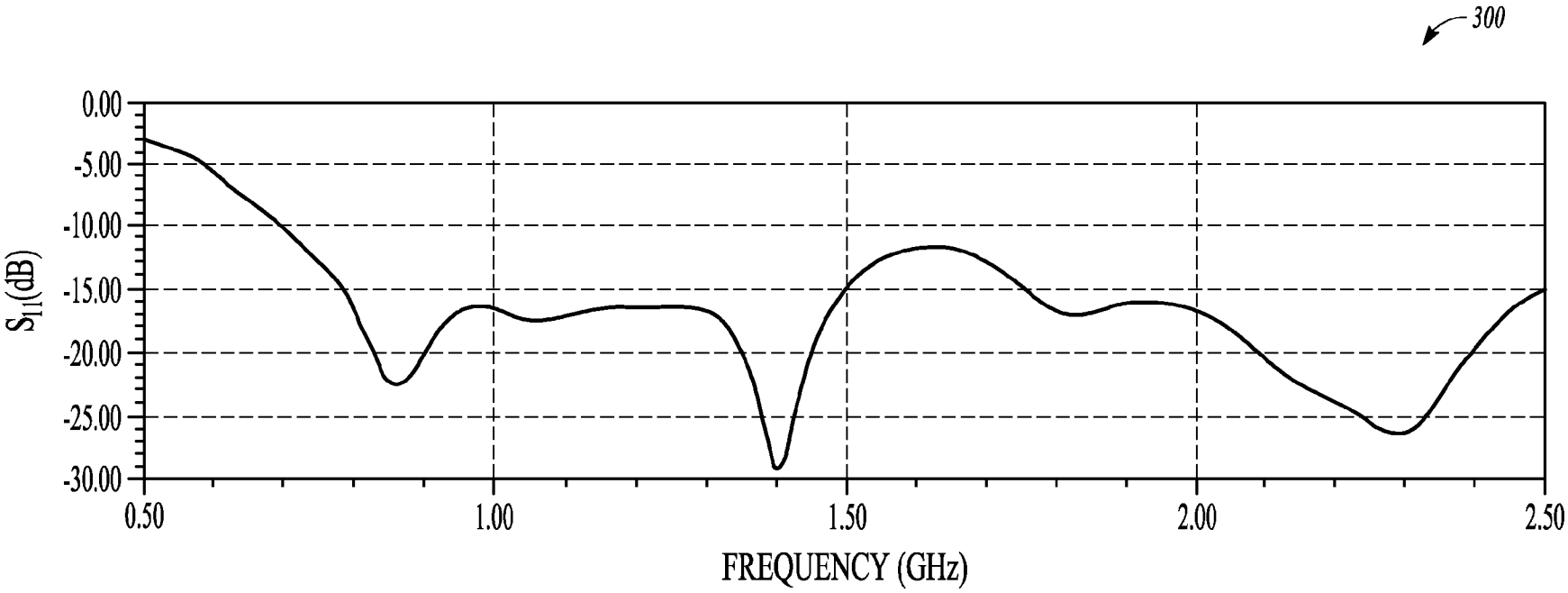
FIG. 3 illustrates generally an illustrative example of a return loss simulated for the antenna configuration of FIG. 1.

FIG. 3 illustrates generally an illustrative example of a return loss (e.g., an $S_{11}$ parameter) simulated for the antenna configuration of FIG. 1. In an example, the trace feeding the antenna assembly 102, such as shown in FIG. 1, can include a coplanar waveguide, such as to provide a specified input impedance corresponding to a specified range of operating frequencies. For example, a voltage standing wave ratio (VSWR) of 2:1 or less can be specified (e.g., as a design constraint), such as corresponding to an $S_{11}$ parameter of about −10 dB. In this illustrative example, FIG. 3 shows that the return loss meets or exceeds (e.g., outperforms) such a specification in a frequency range spanning roughly from about 600 MHz. to more than about 2500 MHz. (e.g., more than an octave, or a doubling in frequency, from the lowest usable operating frequency to the highest usable operating frequency). In another illustrative example, according to a network analyzer measurement on a prototype similar to the examples of FIGS. 1, and 2A-B, such an antenna configuration can provide a usable frequency range spanning from around 600 MHz. to around 6700 MHz., covering a large portion of the frequency range used by most wireless device standards or regulations, in most geographies. Thus, a single antenna such as shown in FIG. 1 could replace multiple separate antennas in a product destined for use at a variety of different frequencies, or needing wideband coverage of a broad range of frequencies. For example, an antenna configuration such as shown in FIGS. 1 and 2A-B or simulated in FIG. 3 can be operated according to one or more "ultrawideband" (UWB) standards, such as for transmission or reception of wideband pulsed digital information at low power (or other pulse-shaped waveforms such as for radar or other applications), such as providing a specified or desired level of signal integrity, minimizing or reducing dispersion or spreading, such as including a usable bandwidth in excess of about 500 MHz., or more.

Figure 4:
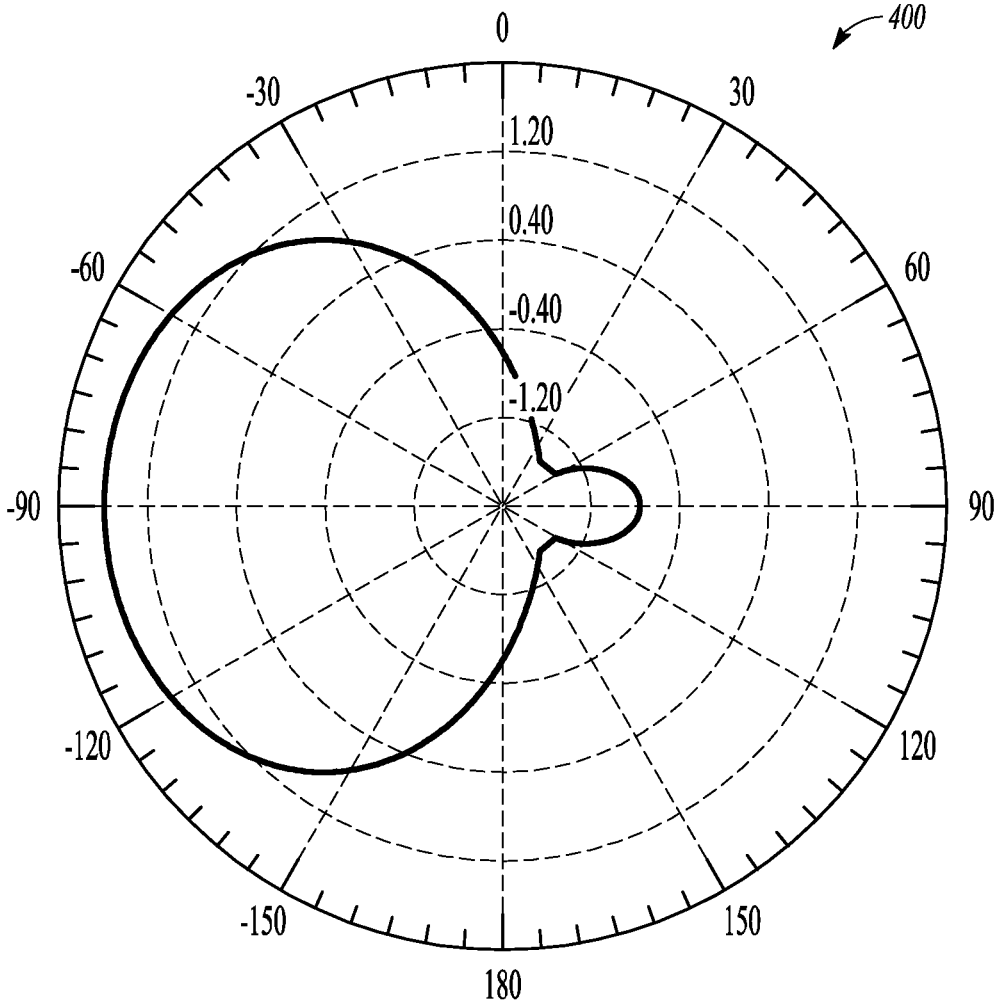
FIG. 4 illustrates generally an illustrative example of a radiation pattern simulated for the antenna configuration of FIG. 1.

FIG. 4 illustrates generally an illustrative example of a radiation pattern 400 simulated for the antenna configuration of FIG. 1, such as including a radiation in a horizontal plane at the level of the top of the conductive housing 114 shown in the example of FIG. 1 (e.g., the conductive portion 104 and antenna assembly 102 oriented vertically as shown in FIG. 1). The shape of radiation pattern 400 includes a variation in radiation of less than 4 dB around the horizontal plane, showing that the antenna assembly 102 is relatively omnidirectional in an azimuthal plane. In the example of FIGS. 1 and 2A-B, the antenna assembly 102 can have a null in a vertical direction, since such a direction is approximately orthogonal to the dominant horizontal plane of radiation, but such a null can be relatively narrow in comparison to the rest of the radiation pattern of the antenna assembly 102.

FIG. 5 illustrates generally an example of an apparatus 500 that can include an approximately planar antenna assembly, similar to the examples of FIGS. 1, 2A-B, and 3, such as including a passively-driven element. In the example of FIG. 5, the antenna assembly can include a first conductive portion 502A, such as located on a first conductive layer of a printed circuit board assembly. A second conductive portion 502B can be located on a second conductive layer of the printed circuit board assembly, such as separate by a dielectric portion 504. As in the examples above, one or more of the first or second portions can include at least one edge defined by a planar projection or cut of a conic section, such as one or more of an elliptical, parabolic, or hyperbolic shape. In the example of FIG. 5, the second conductive portion 502B need not be conductively coupled to a feed or trace. The second conductive portion 502B can be passively driven, such as through reactive or capacitive coupling to the first conductive portion 502A. In this manner, a usable range of operating frequencies can be adjusted, such as by providing a particular combination of modes supported by the first conductive portion, or the second conductive portion, or both, either extending a usable range of operating frequencies, or providing an input impedance more closely approximating a desired input impedance within a desired range of frequencies.

Figure 6:
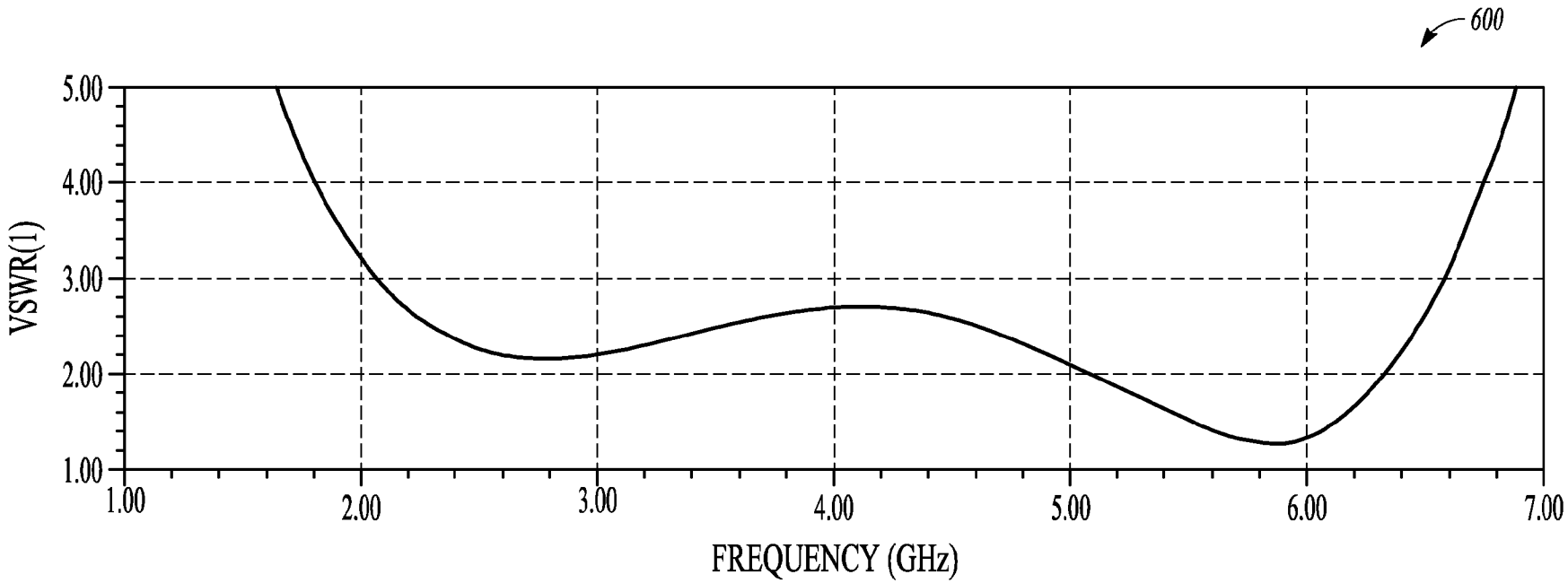
FIG. 6 illustrates generally an illustrative example of a return loss simulated for the antenna configuration of FIG. 5.

FIG. 6 illustrates generally an illustrative example of a voltage standing wave ratio (VSWR) 600 simulated for the antenna configuration of FIG. 5. In the illustrative example of FIG. 6, if a desired VSWR is specified as 3.0 or less, a usable range of frequencies can span from just about 2 GHz. to more than 6 GHz., a span of more than an octave where the VSWR is below 3.0. For example, a VSWR of 3.0 can correspond to an S11 parameter value of about −6 dB.

Figure 7:
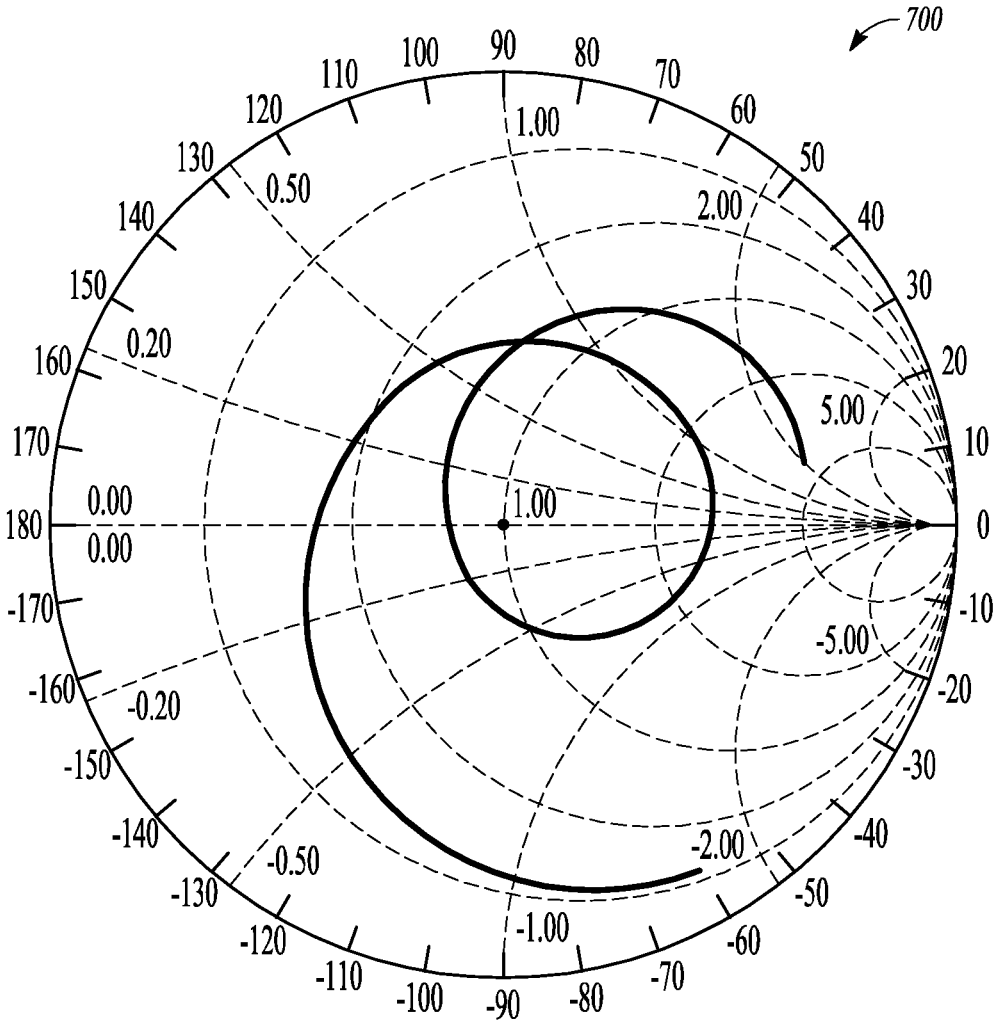
FIG. 7 illustrates generally an illustrative example of an impedance Smith Chart simulated for the antenna configuration of FIG. 5.

FIG. 7 illustrates generally an illustrative example of an impedance Smith Chart 700 simulated for the antenna configuration of FIG. 5. Similar to the illustrative example of FIG. 6, a "curl" in the impedance versus operating frequency encircles the unit real impedance point 1.00 at the center of the chart (e.g., corresponding to a real impedance of 50 ohms). In an example, one or more of the first or second conductive portions 502A-B of FIG. 5 can be adjusted (e.g., made larger or smaller), such as to shift the locus of the "curl" in the Smith Chart 700, such as shown in FIG. 7 to provide an impedance that remains close to 50 ohms (real), over a variety of frequencies. This can be shown in the Smith Chart as a locus of points either encircling or at least approaching the unit real impedance point (or corresponding to some other specified input impedance).

Figure 8:
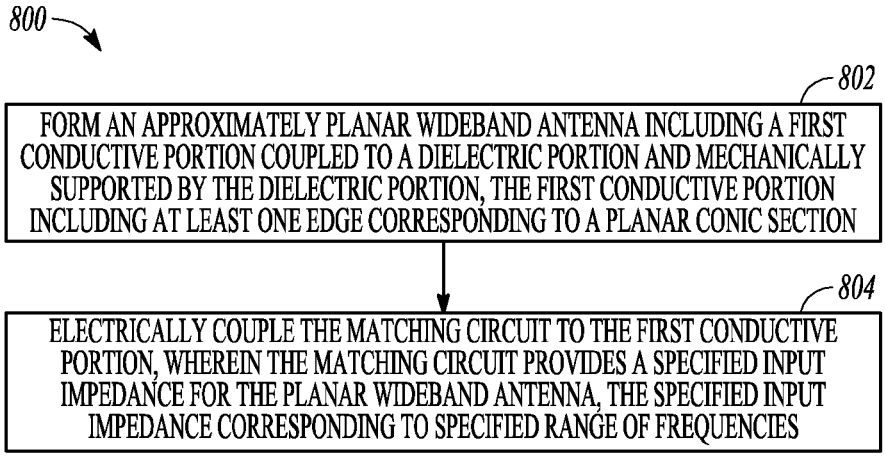
FIG. 8 illustrates generally a technique 800 that can include forming an approximately planar wideband antenna.

FIG. 8 illustrates generally a technique 800 that can include forming an approximately planar wideband antenna. For example, at 802, an approximately planar wideband antenna can be formed, such as including a first conductive portion. The first conductor can include at least one edge corresponding to a planar conic section (e.g., including an elliptic, a parabolic, or a hyperbolic shape). At 804, a matching circuit can be electrically coupled to the first conductive portion, such as to provide a specified input impedance corresponding to a specified range of operating frequencies spanning at least an octave (e.g., as shown in the examples of FIGS. 3 and 6, and discussed in other examples above). Such fabrication techniques can include one or more of stamping, etching, patterning, cutting, or otherwise providing a first conductive portion, such as coupled to a dielectric portion as shown in the examples of FIGS. 1, 2A-B, and FIG. 5.

Figure 9:
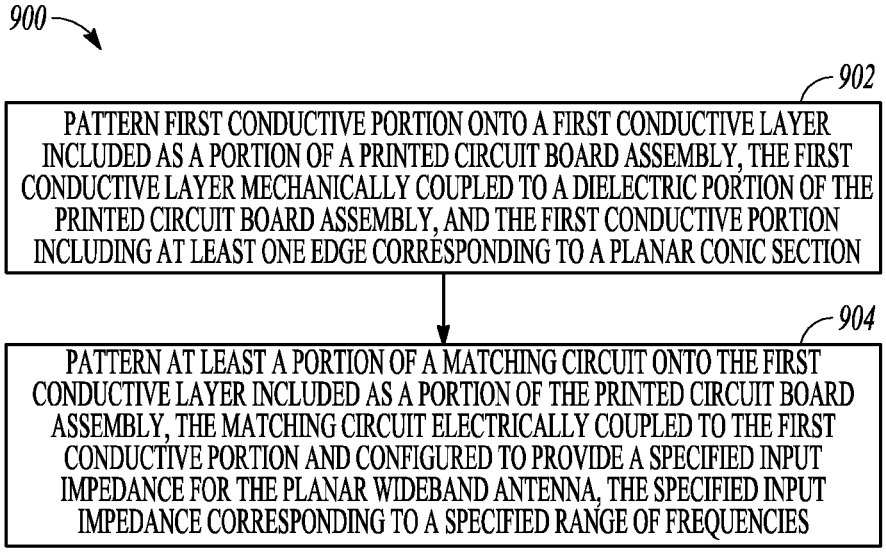
FIG. 9 illustrates generally a technique 900 that can include forming an approximately planar wideband antenna.

FIG. 9 illustrates generally a technique 900 that can include forming an approximately planar wideband antenna. For example, at 902, a first conductive portion can be patterned onto a first conductive layer included as a portion of a printed circuit board assembly. In an example, such as shown above in the example of FIGS. 1, 2A-B, and FIG. 5, the conductive portion can be coupled (e.g., adhered, sandwiched, or otherwise mechanically attached) to a dielectric portion. At 904, at least a portion of a matching circuit can be patterned onto the first conductive layer. The matching circuit can be electrically coupled to the first conductive portion, such as shown in the examples of FIGS. 1, 2-A-B, and FIG. 5, such as including a matching section comprising a coplanar waveguide or other structure. In an example, the matching circuit can provide a specified input impedance corresponding to a specified range of frequencies spanning at least an octave. As in the examples above, the first conductive portion can include a planar conic section comprising at least one edge including one or more of an elliptic, a parabolic, or a hyperbolic shape.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An apparatus, comprising:

an approximately planar wideband antenna including a first conductive portion coupled to a dielectric portion and mechanically supported by the dielectric portion, the first conductive portion including at least one edge corresponding to a planar conic section;

a matching circuit electrically coupled to the first conductive portion and configured to provide a specified input impedance corresponding to a specified range of frequencies;

a printed circuit board assembly including a return plane, wherein the return plane is located near a conductive housing and electrically coupled to the conductive housing;

wherein the specified range of frequencies includes a range of frequencies spanning at least an octave; and wherein the planar conic section includes one or more of an elliptic, a parabolic, or a hyperbolic shape.

2. The apparatus of claim 1, wherein the matching circuit is conductively coupled to the first conductive portion.

3. The apparatus of claim 1, wherein the matching circuit is reactively coupled to the first conductive portion.

4. The apparatus of claim 1, wherein the matching circuit comprises a distributed matching structure coupled to the first conductive portion of the planar wideband antenna and configured to provide, at least in part, the specified input impedance at least in part using a distributed inductance or capacitance of the distributed matching structure.

5. The apparatus of claim 2, wherein the distributed matching structure includes a coplanar waveguide.

6. The apparatus of claim 4, wherein the matching circuit comprises a discrete component; and wherein the combination of the discrete component and the distributed matching structure are configured to provide the specified input impedance.

7. The apparatus of claim 1, wherein the printed circuit board assembly includes a conductive layer comprising the first conductive portion and a dielectric layer comprising the dielectric portion.

8. The apparatus of claim 7, wherein the dielectric portion includes a glass-epoxy laminate, and wherein the first conductive portion includes copper.

9. The apparatus of claim 1, wherein the conductive housing at least partially contains a transmitter or a receiver circuit configured to use the planar wideband antenna to wirelessly transfer information electromagnetically using at least a portion of the specified range of frequencies.

10. The apparatus of claim 1, comprising a second conductive portion including at least one edge corresponding to a planar conic section.

11. The apparatus of claim 10, wherein one or more of the first conductive portion or the matching circuit is electrically coupled to the second conductive portion reactively.

12. The apparatus of claim 10, wherein the first conductive portion is located on a first conductive layer of a printed circuit board assembly, and wherein the second conductive portion is located on a second conductive layer of the printed circuit board assembly.

13. The apparatus of claim 1, wherein the specified range of frequencies includes a range from about 700 MHz. to about 2500 MHz.

14. A method, comprising:

forming an approximately planar wideband antenna including a first conductive portion coupled to a dielectric portion and mechanically supported by the dielectric portion, the first conductive portion including at least one edge corresponding to a planar conic section;

fabricating a printed circuit board assembly including a return plane, wherein the return plane is located near a conductive housing and electrically coupled to the conductive housing;

electrically coupling a matching circuit to the first conductive portion;

wherein the matching circuit provides a specified input impedance for the planar wideband antenna, the specified input impedance corresponding to a specified range of frequencies;

wherein the specified range of frequencies includes a range of frequencies spanning at least an octave; and wherein the planar conic section includes one or more of an elliptic, a parabolic, or a hyperbolic shape.

15. The method of claim 14, comprising providing a second conductive portion including at least one edge corresponding to a planar conic section.

16. The method of claim 15, wherein the forming includes:

forming the first conductive portion on a first conductive layer;

forming the second conductive portion on a second conductive layer; and separating the first and second conductive layers using the dielectric portion.

17. A method for forming an approximately planar wideband antenna, comprising:

patterning a first conductive portion onto a first conductive layer included as a portion of a printed circuit board assembly, the first conductive layer mechanically coupled to a dielectric portion of the printed circuit board assembly, and the first conductive portion including at least one edge corresponding to a planar conic section;

patterning at least a portion of a matching circuit onto the first conductive layer included as a portion of the printed circuit board assembly, the matching circuit electrically coupled to the first conductive portion and configured to provide a specified input impedance for the planar wideband antenna, the specified input impedance corresponding to a specified range of frequencies;

wherein the printed circuit board assembly includes a return plane that is located near a conductive housing and electrically coupled to the conductive housing;

wherein the specified range of frequencies includes a range of frequencies spanning at least an octave; and wherein the planar conic section includes one or more of an elliptic, a parabolic, or a hyperbolic shape.

18. The method of claim 17, wherein the forming a planar wideband antenna includes patterning a second conductive portion, the second conductive portion including at least one edge corresponding to a planar conic section.

19. The method of claim 18, wherein patterning the second conductive portion includes patterning the second conductive portion onto a second conductive layer included as a portion of the printed circuit board assembly; and wherein the first and second conductive layers are separated by the dielectric portion.

* * * * *